US011613438B2

(12) United States Patent
Misao

(10) Patent No.: US 11,613,438 B2
(45) Date of Patent: Mar. 28, 2023

(54) IMAGE FORMING APPARATUS AND PAPER FEED SYSTEM

(71) Applicant: CANON KABUSHIKI KAISHA, Tokyo (JP)

(72) Inventor: Yoji Misao, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 134 days.

(21) Appl. No.: 17/026,006

(22) Filed: Sep. 18, 2020

(65) Prior Publication Data

US 2021/0094777 A1 Apr. 1, 2021

(30) Foreign Application Priority Data

Sep. 26, 2019 (JP) ..... JP2019-175898

(51) Int. Cl.

| | |
|---|---|
| ***B65H 3/00*** | (2006.01) |
| ***G03G 15/00*** | (2006.01) |
| ***G03G 21/16*** | (2006.01) |
| ***B65H 3/44*** | (2006.01) |
| ***B65H 1/26*** | (2006.01) |

(52) U.S. Cl.

CPC ..... *B65H 3/44* (2013.01); *B65H 1/266* (2013.01); *G03G 15/6502* (2013.01); *G03G 21/1647* (2013.01); *G03G 21/1695* (2013.01)

(58) Field of Classification Search

CPC ..... G03G 15/6502; G03G 21/1619; G03G 21/1647; G03G 21/1695; B65H 1/266; B65H 3/44; B65H 2402/10; B65H 2402/44; B65H 2402/61; B65H 2405/332

See application file for complete search history.

(56) References Cited

U.S. PATENT DOCUMENTS

| | | | | |
|---|---|---|---|---|
| 5,191,382 | A * | 3/1993 | Okamura | G03G 15/6502 399/391 |
| 5,472,183 | A * | 12/1995 | Kubo | G03G 15/6502 271/9.03 |
| 2005/0100362 | A1* | 5/2005 | Kim | G03G 15/50 399/388 |
| 2017/0108818 | A1* | 4/2017 | Hashimoto | G03G 21/1619 |
| 2017/0343947 | A1* | 11/2017 | Hozono | G03G 15/6502 |
| 2020/0231394 | A1* | 7/2020 | Adaniya | G03G 21/1647 |
| 2020/0331716 | A1* | 10/2020 | Takahashi | B65H 1/266 |
| 2021/0063950 | A1* | 3/2021 | Ishii | G03G 21/1619 |

FOREIGN PATENT DOCUMENTS

JP 2017-74774 A 4/2017

* cited by examiner

*Primary Examiner* — Sophia S Chen
(74) *Attorney, Agent, or Firm* — Canon U.S.A., Inc. I.P. Division

(57) ABSTRACT

An image forming apparatus includes a paper feed device and an image forming apparatus main body including a paper feed cassette removable from the image forming apparatus main body and including an image forming unit. The paper feed cassette stores a recording material, and the image forming unit forms an image on the recording material. The paper feed device allows the image forming apparatus main body to be stacked on the paper feed device below the paper feed cassette. The paper feed device is provided with a coupling section. In a space formed in a case where the paper feed cassette is removed from the image forming apparatus main body, the coupling section is fixed to the image forming apparatus main body by a fixing unit to couple the image forming apparatus main body and the paper feed device together.

18 Claims, 6 Drawing Sheets

IMAGE FORMING APPARATUS AND PAPER FEED SYSTEM

BACKGROUND

Field

The present disclosure relates to an image forming apparatus and a paper feed system.

Description of the Related Art

For an image forming apparatus that forms an image on a sheet of paper using an electrophotographic method, it is desired to save space by reducing installation areas of respective devices, and in increasing cases, the image forming apparatus includes a paper feed device, on which an image forming apparatus main body or another paper feed device can be stacked. In order to prevent the stacked image forming apparatus and paper feed device or the stacked paper feed devices from coming off from each other during transportation or during an earthquake, the image forming apparatus and the paper feed device or the paper feed devices may be coupled together to avoid displacement. For example, there is discussed a configuration in which a hiding cover that hides a coupling section between an image forming apparatus and a paper feed device is removed, and a screw is tightened toward the inside of the image forming apparatus or the paper feed device to couple the image forming apparatus and the paper feed device together (Japanese Patent Application Laid-Open No. 2017-74774). With this configuration, the removal of the hiding cover requires of an operator some effort and, moreover, the operator may lose the hiding cover or forget to attach the hiding cover.

In recent years, an image forming apparatus such as a printer or a copying machine has been required to reduce the time taken for installation work and maintenance thereof. There is a demand for a configuration in which an image forming apparatus and a paper feed device, or a paper feed device and another paper feed device can be easily coupled together and the work time for the coupling can be reduced.

SUMMARY

The present disclosure is directed to a configuration in which an image forming apparatus main body and a paper feed device, or a paper feed device and another paper feed device can be easily coupled together and the work time for the coupling can be reduced.

According to an aspect of the present disclosure, an image forming apparatus includes an image forming apparatus main body including a paper feed cassette removable from the image forming apparatus main body and configure to store a recording material, and including an image forming unit configured to form an image on the recording material, and a paper feed device configured to allow the image forming apparatus main body to be stacked on the paper feed device below the paper feed cassette, wherein the paper feed device is provided with a coupling section, and wherein, in a space formed in a case where the paper feed cassette is removed from the image forming apparatus main body, the coupling section is fixed to the image forming apparatus main body by a fixing unit to couple the image forming apparatus main body and the paper feed device together.

Further features of the present disclosure will become apparent from the following description of exemplary embodiments with reference to the attached drawings.

DESCRIPTION OF THE EMBODIMENTS

<Image Forming Apparatus>

Figure 2:
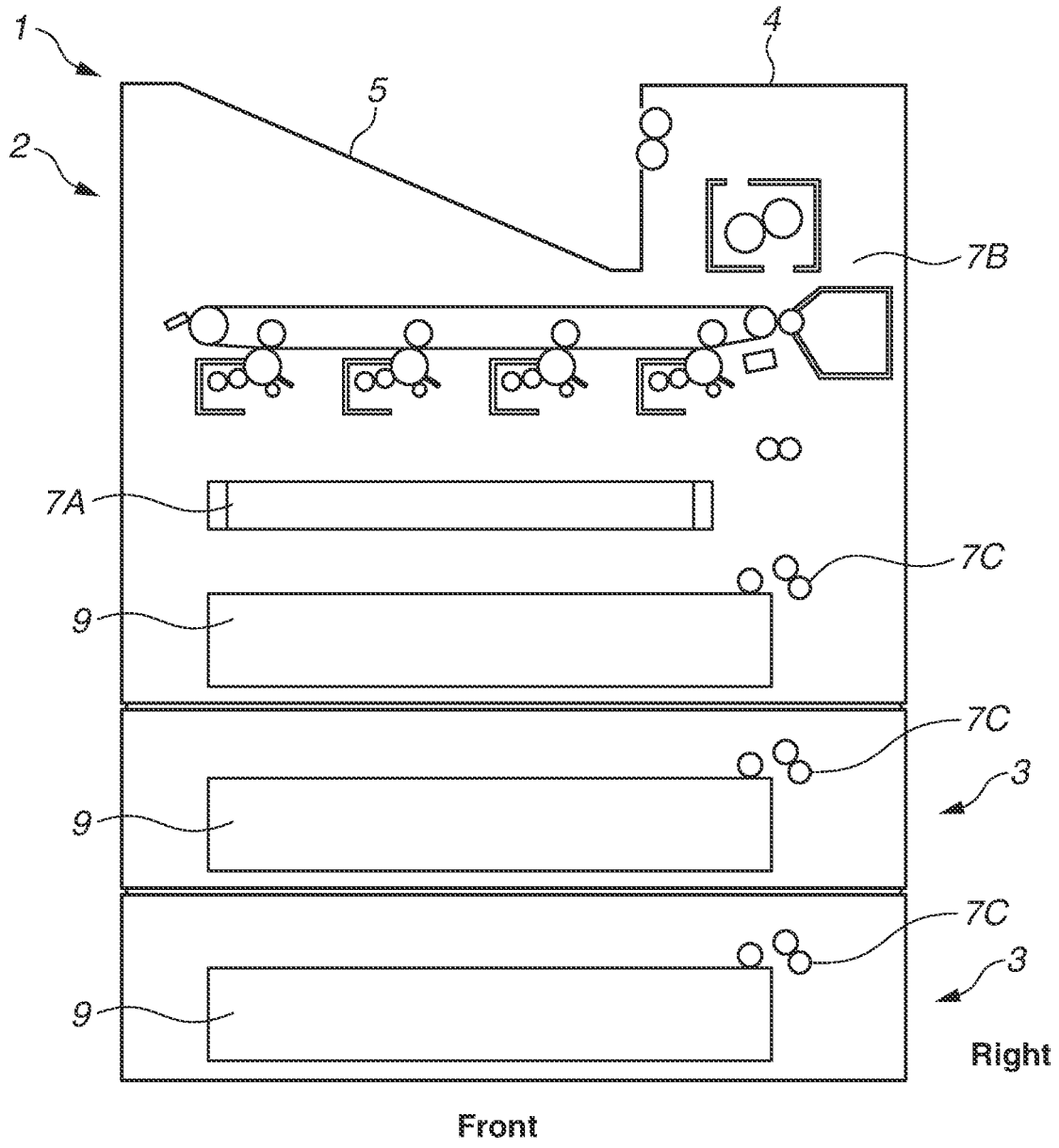
FIG. 2 is a front sectional view of an entire image forming apparatus according to an exemplary embodiment of the present disclosure.

The following description is made on an apparatus main body 2 and a paper feed device 3, which constitute one example of an image forming apparatus to which the present disclosure can be applied. FIG. 2 is a front sectional view of an image forming apparatus 1 according to an exemplary embodiment of the present disclosure, which is a laser printer. In a configuration as illustrated in FIG. 2, the apparatus main body 2 is stacked on two stacked paper feed devices 3.

The apparatus main body 2 includes an exterior cover 4, and apart of the exterior cover 4 is provided with a paper discharge unit 5 for discharging a sheet of paper with an image formed thereon. Below the paper discharge unit 5, an optical scan device 7A that emits laser light based on an image signal, an image forming unit 7B that can form an image based on the laser light emitted from the optical scan device 7A, and a paper feed cassette 9 that stores a plurality of sheets of paper are provided in the apparatus main body 2. In addition to a paper feeding unit 7C that feeds the sheets of paper from the paper feed cassette 9 to the image forming unit 7B one by one, the apparatus main body 2 includes a paper discharging unit that conveys the sheet of paper, on which an image is formed in the image forming unit 7B, toward the paper discharge unit 5. The image forming unit 7B includes various processing devices such as a photosensitive drum that is an image carrier, a charging device, a developing device, a cleaning device, and a fixing device.

Figure 3:
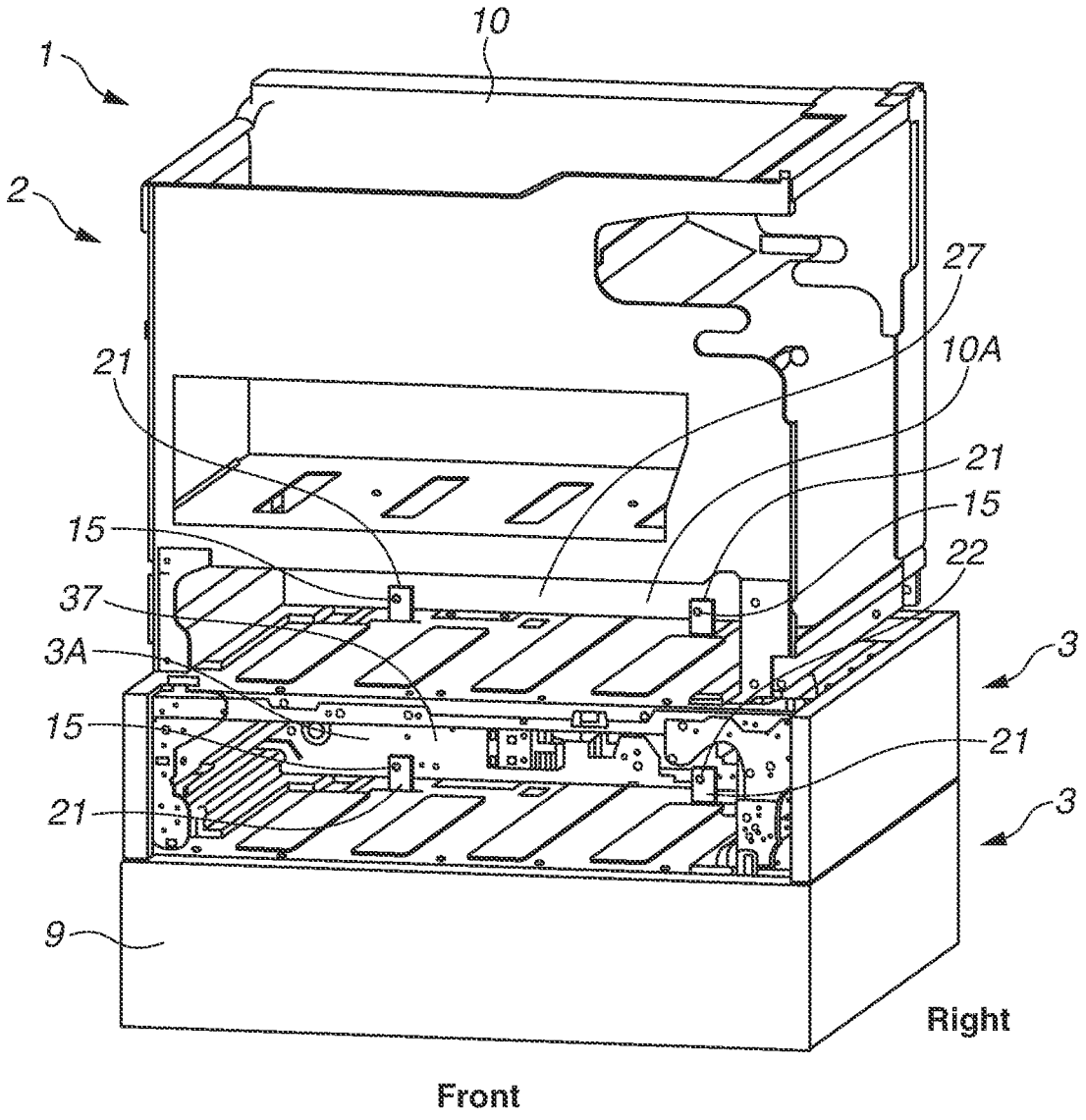
FIG. 3 is a perspective view of an apparatus main body frame and a paper feed device according to the first exemplary embodiment.

The apparatus main body 2 includes, in an inside of the exterior cover 4, the optical scan device 7A, the image forming unit 7B, the paper feed cassette 9, the paper feeding unit 7C, and a frame 10 supporting the paper discharging unit. FIG. 3 illustrates, for convenience of explanation, a configuration in which only the frame 10 is stacked as the apparatus main body 2 on the two stacked paper feed devices 3, and one paper feed device 3 and the frame 10 are coupled together by a plurality of coupling sections 21. The frame 10 is provided with a circular hole 22 (FIG. 1A) that fixes a screw 15.

As described above, in the apparatus main body 2, a recording material is conveyed from the paper feed cassette 9, which is provided at the lower side of the apparatus, to the upper side of the apparatus through a right side of the image forming apparatus, where a secondary transfer unit and a fixing unit are provided. Then, the recording material is discharged toward the left side of the apparatus in such a manner that the recording material is loaded on the paper discharge unit 5. The paper feed cassette 9 can be pulled out in a direction orthogonal to a direction in which the recording material is conveyed.

<Paper Feed Device>

Figure 4B:
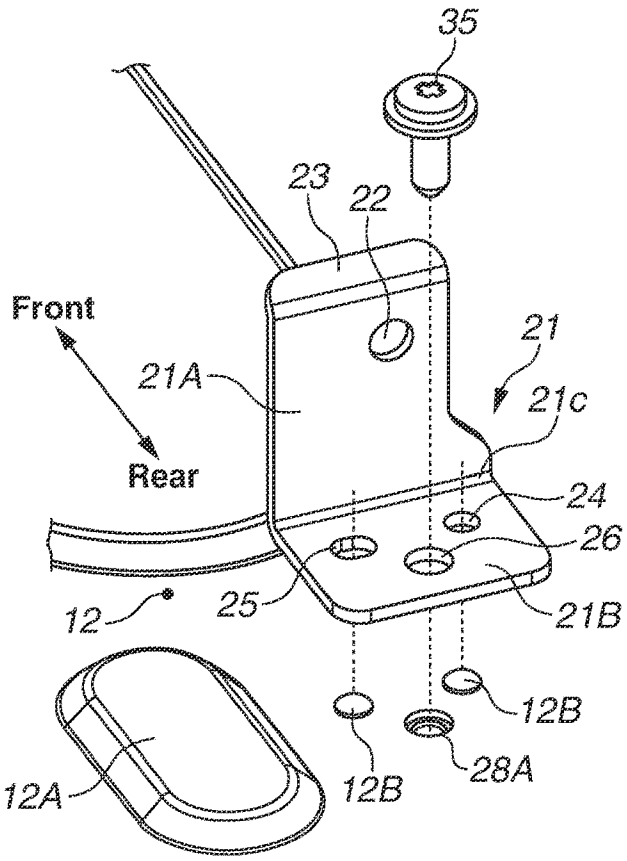
FIGS. 4A and 4B are perspective views of the paper feed device according to the first exemplary embodiment.
Figure 4A:
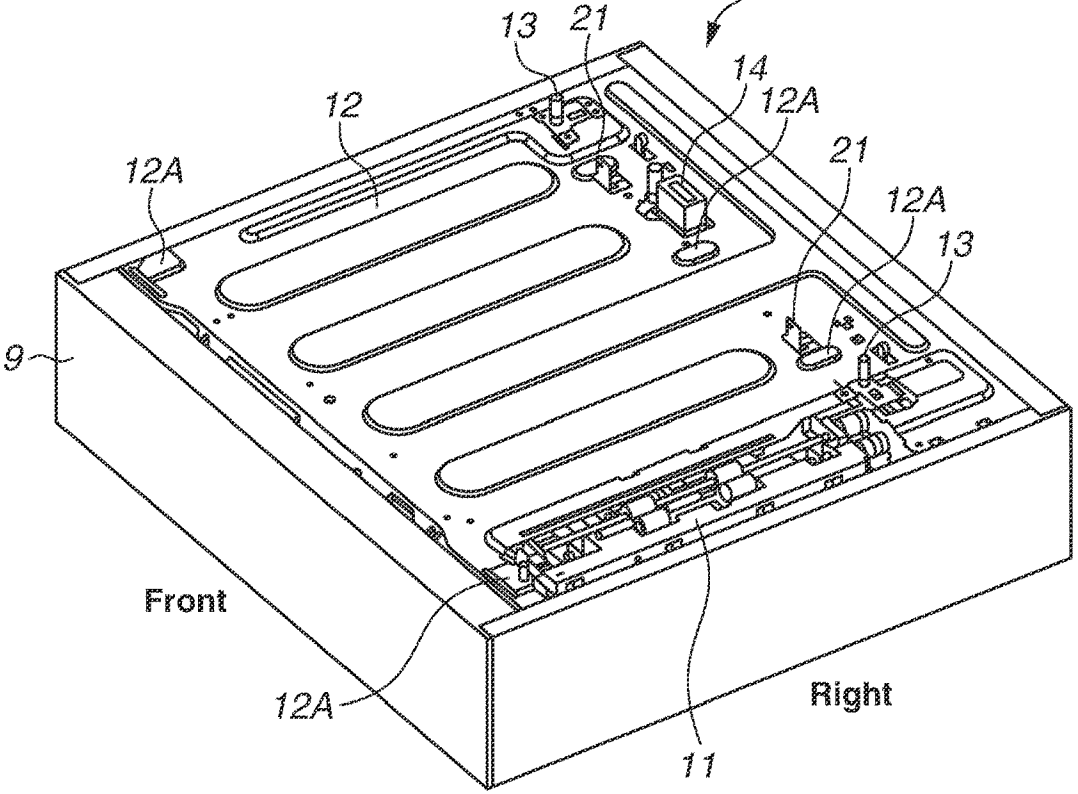

FIG. 4A is a perspective view of the paper feed device 3 according to a first exemplary embodiment of the present disclosure. The paper feed device 3 stores loaded sheets of paper and conveys to feed the sheets of paper one by one to the apparatus main body 2. The paper feed device 3 includes a frame 3A, a paper feed cassette 9 that is contained in the frame 3A and can be pulled out to a front side of the paper feed device 3, a paper feed unit that conveys the sheets of paper loaded on the paper feed cassette 9 one by one, and a conveyance unit 11 that conveys the sheets of paper conveyed by the paper feed unit to the apparatus main body 2. A top plate 12 arranged at a top of the paper feed device 3 is provided with a plurality of main body installation sections 12A, a plurality of positioning pins 13, a screw hole 28A, and a plurality of bosses 12B. Specifically, the main body installation sections 12A are provided at four places to support the load of the apparatus main body 2. The plurality of positioning pins 13 are provided at two places, engage with positioning holes in a bottom surface of the frame 10 of the apparatus main body 2 to position the apparatus main body 2 and the paper feed device 3 in the front and rear directions and the right and left directions, and are disposed at end portions of the paper feed device 3. The plurality of bosses 12B are provided at two places, and the screw hole 28A and the bosses 12B are for fixing each of the plurality of coupling sections 21 described below at a predetermined position.

In the paper feed device 3, the conveyance unit 11 that conveys the recording material to the apparatus main body 2 is provided on the right side of the image forming apparatus, where the secondary transfer unit and the fixing unit are provided. On a rear side of the paper feed device 3, a connector 14 that makes an electrical connection to the apparatus main body 2 is arranged between the positioning pins 13 and, at the same time, between the plurality of coupling sections 21.

<Coupling Structure>

A coupling structure of the apparatus main body 2 and the paper feed device 3 will be described. In the coupling structure of the present exemplary embodiment, the apparatus main body 2 and the paper feed device 3 are coupled together by the plurality of coupling sections 21. As illustrated in FIG. 4A, on the rear side of the apparatus main body 2, one coupling section 21 is arranged on each of the right and left sides. FIG. 4B is an enlarged perspective view illustrating one of the plurality of coupling sections 21 in FIG. 4A as viewed from the rear side of the apparatus main body 2.

Each of the coupling sections 21 is a press-molded product that is bent in an L shape, and has a first portion 21A and a second portion 21B connected to each other via a bent portion 21C. The circular hole 22 is formed in the first portion 21A, and a curve portion 23 is formed at a tip of an end of the first portion 21A that is paired with the other end where the first portion 21A is connected to the second portion 21B via the bent portion 21C. In addition, the second portion 21B is provided with a circular hole 24, a long hole 25, and a circular hole 26 having a diameter larger than the diameter of the circular hole 24.

Figure 1A:
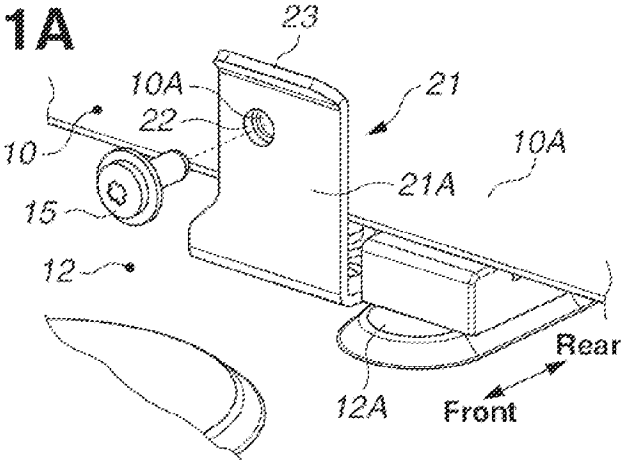
FIGS. 1A and 1C are perspective views of a coupling section according to a first exemplary embodiment.

Each of the coupling sections 21 is positioned with respect to the paper feed device 3 by the circular hole 24 being engaged with one boss 12B, and restricted from rotating by the long hole 25 being engaged with the other boss 12B. In this way, the coupling section 21 is disposed at a correct position with respect to the top plate 12. Then, the screw 35 is fixed to the screw hole 28A provided at a position corresponding to the circular hole 26 of the coupling section 21 through the circular hole 26, so as to fix the apparatus main body 2 to the paper feed device 3 (top plate 12). On the other hand, as illustrated in FIG. 1A, the coupling section 21 is fixed to the apparatus main body 2 by attaching a screw 15 to a circular hole 10B provided in a rear side plate 10A of the frame 10 through the circular hole 22. In this way, the apparatus main body 2 and the paper feed device 3 are coupled together by the coupling sections 21.

Figure 1B:
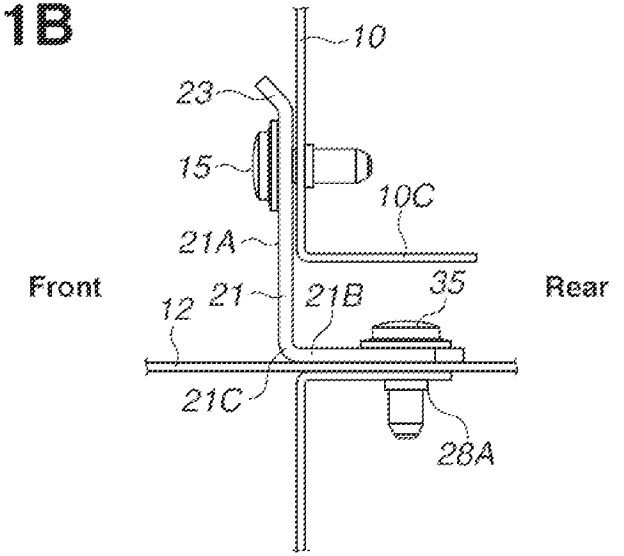
FIG. 1B is a cross-sectional view of the coupling section.
Figure 1C:
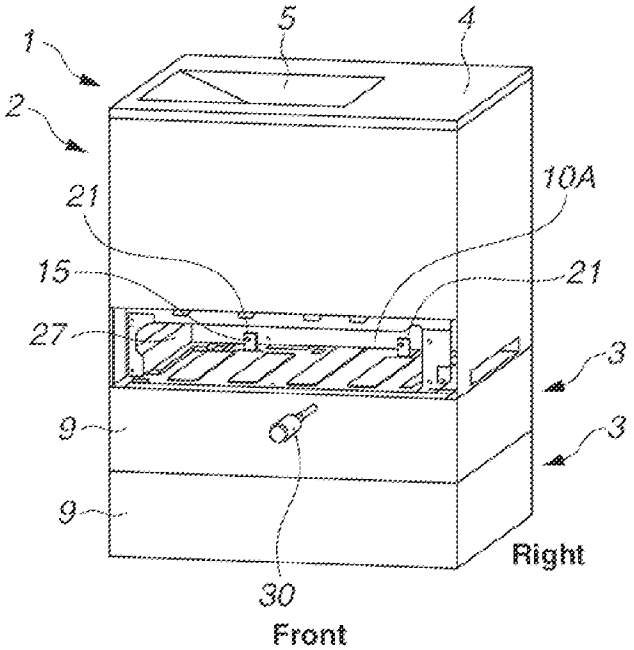

A process for coupling the apparatus main body 2 and the paper feed device 3 together will be described with reference to FIGS. 1A to 1C. FIG. 1C illustrates a state where the apparatus main body 2 is installed on the paper feed device 3, and FIG. 1B illustrates a cross section of the coupling section 21 in FIG. 1A as viewed from the right side.

First, the coupling section 21 is fixed to the top plate 12 of the paper feed device 3. The coupling section 21 is disposed on the top plate 12 in such a manner that one boss 12B engages with the circular hole 24 and the other boss 12B engages with the long hole 25, and then the screw 35 is fixed to the screw hole 28A through the circular hole 26. In this way, the coupling section 21 is fixed to the paper feed device 3.

Next, the apparatus main body 2 is installed on the paper feed device 3. The plurality of positioning pins 13 engage with the positioning holes provided in the frame 10 of the apparatus main body 2, the apparatus main body 2 and the paper feed device 3 are positioned in the front and rear directions and the right and left directions, and then the load of the apparatus main body 2 is supported by the main body installation sections 12A. In the present exemplary embodiment, the coupling sections 21 are arranged between two positioning pins 13 so that the respective positions of the circular hole 22 of the coupling section 21 and the circular hole 10B of the frame 10 can be prevented from shifting.

In addition, in such arrangement of the coupling section 21, in the present exemplary embodiment, the first portion 21A of the coupling section 21 is located inside the image forming apparatus 1 (on the front side, or one side, of the image forming apparatus 1) with respect to the rear side surface of the frame 10 of the apparatus main body 2, so that the first portion 21A and the rear side surface of the frame 10 can be adjacent to each other. Therefore, the curve portion 23 has a shape that extends toward the inside (the front side, or the one side) of the image forming apparatus 1 from the outside (the rear side) of the image forming apparatus 1 as going away from the bent portion 21C, that is, as approaching the apparatus main body 2. In this manner, the first portion 21A is so configured as not to interfere with the frame 10 when the apparatus main body 2 is placed on the paper feed device 3. In other words, the curve portion 23 is so configured as to allow the frame 10 to be guided to a predetermined position in a sliding manner when the apparatus main body 2 is placed on the paper feed device 3.

Then, the respective coupling sections 21 are fixed to the apparatus main body 2, and the apparatus main body 2 and the paper feed device 3 are coupled together by the coupling sections 21. In each of the coupling sections, the screw 15 is attached to the circular hole 10B provided in the rear side plate 10A of the frame 10 through the circular hole 22 of the coupling section 21. Then, the paper feed device 3 is fixed to the apparatus main body 2. In the present exemplary embodiment, when tightening the screw 15, a tool 30 such as a driver is put in a space 27 formed by removing the paper feed cassette 9 of the apparatus main body 2 to an outside of the image forming apparatus 1 and the screw 15 is tightened, as illustrated in FIG. 1C. In other words, in the space 27 formed by removing the paper feed cassette 9 of the apparatus main body 2 to the outside of the image forming apparatus 1, the screw 15 as a fixing unit is provided, the coupling section 21 is fixed to the apparatus main body 2, and the apparatus main body 2 and the paper feed device 3 are coupled together by the coupling sections 21.

In the present exemplary embodiment, in the coupling section 21, the second portion 21B extends from the front side of the image forming apparatus 1 toward the rear side of the image forming apparatus 1 with respect to the first portion 21A. In the frame 10, a curve portion 10C is provided at a lower end of the rear side plate 10A, and the curve portion 10C also extends from the front side of the image forming apparatus 1 toward the rear side of the image forming apparatus 1. Therefore, although the work space is the space 27 formed by removing the paper feed cassette 9 of the apparatus main body 2 to the outside of the image forming apparatus 1, there is no interference on the front side of the rear side plate 10A of the frame 10, which corresponds to the front side of the image forming apparatus 1, during a work of attaching the screw 15, and workability can be improved.

As described above, in a configuration where the paper feed cassette 9, which is easily removable, is removed from the apparatus main body 2, and the apparatus main body 2 and the paper feed device 3 are coupled together in the space 27 formed by removing the paper feed cassette 9 from the apparatus main body 2, the coupling is carried out very easily and in a short time. In addition, since the coupling sections 21 are removable from the apparatus main body 2 and the paper feed device 3, if the coupling structure is to be strengthened, it is easy to change a plate thickness and a shape of the respective coupling sections 21, and it is also possible to select the presence or absence of the coupling sections 21 according to a user's request.

Further, in the present exemplary embodiment, the coupling sections 21 are coupled to the rear side plate 10A, which serves as an attachment reference for the respective components. As a result, the apparatus main body 2 and the paper feed device 3 are coupled together with a high position accuracy and, at the same time, the effect of increasing the strength of the rear side plate 10A can be achieved.

The shapes, relative arrangements, and the like of the above-described components in the present exemplary embodiment should be changed appropriately to a configuration of an apparatus, to which the present disclosure is applied, and various conditions, and do not limit the scope of the present disclosure.

For example, while the image forming apparatus, in which the apparatus main body 2 and the paper feed device 3 are coupled together using of the coupling sections 21, has been described, the present disclosure is not limited to such configuration, and can also be applied to a paper feed system in which one paper feed device 3 is coupled to another paper feed device 3. In that case, in a space 37 formed by removing the paper feed cassette 9 from one paper feed device 3, the screw 15 can be attached to the frame 3A of the paper feed device 3 through the circular hole 22 of the respective coupling sections 21 to fix the paper feed devices 3 to each other, as illustrated in FIG. 3.

In the above described present exemplary embodiment, the coupling sections 21 are initially fixed to the top plate 12 of the paper feed device 3, then fixed to the apparatus main body 2 to couple the apparatus main body 2 and the paper feed device 3 together in the space 27 formed by removing the paper feed cassette 9 from the apparatus main body 2. However, the present disclosure is not limited to this. For example, the coupling sections 21 can initially be fixed to the apparatus main body 2, then fixed to the top plate 12 of the paper feed device 3 to couple the apparatus main body 2 and the paper feed device 3 together in the space 27 formed by removing the paper feed cassette 9 from the apparatus main body 2.

Further, in the present exemplary embodiment, the positioning of the respective coupling sections 21 with respect to the paper feed device 3 is performed with the top plate 12 and the coupling sections 21 are fixed to the rear side plate 10A of the frame 10. However, the present disclosure is not limited to this. For example, the top plate 12 and the rear side plate 10A of the frame 10 can be fixed to each other without using the coupling sections 21.

Figure 5:
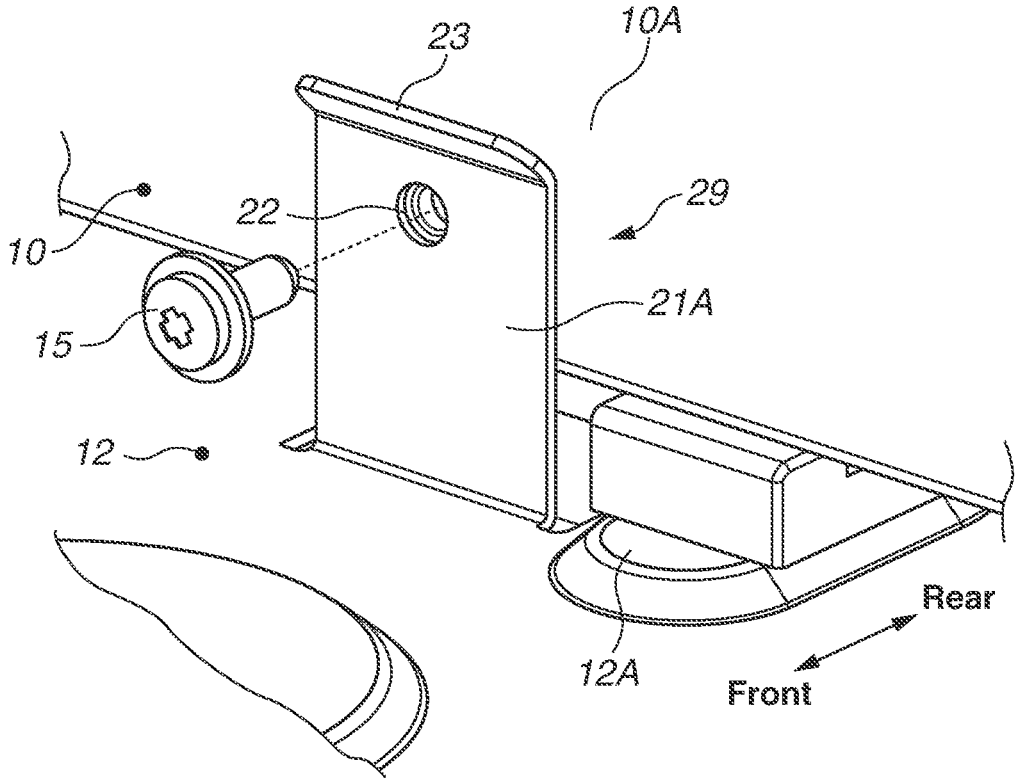
FIG. 5 is a perspective view of a coupling section according to a modification.

More specifically, as illustrated in FIG. 5, without using the coupling section 21 that is a separate member from the top plate 12 in the first exemplary embodiment, a coupling section 29 provided with the circular hole 22 and with the curve portion 23 at the tip can be formed to protrude from the top plate 12.

Figure 6A:
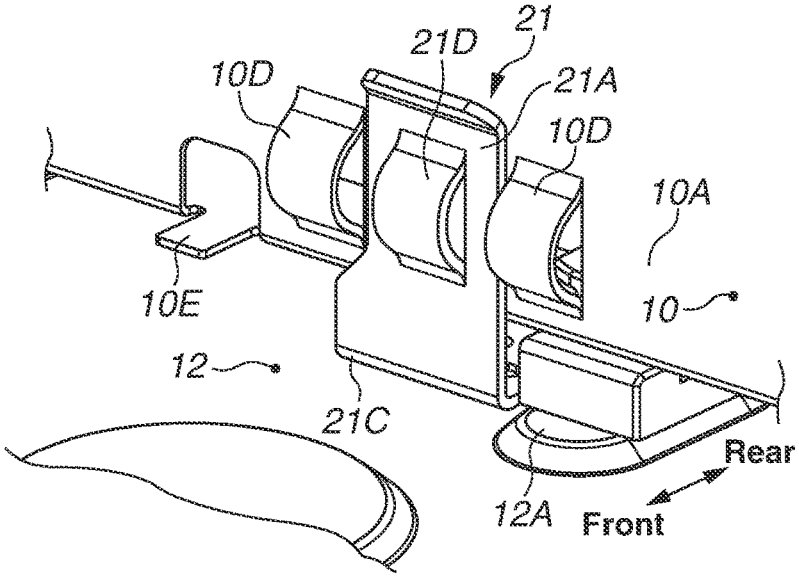
FIGS. 6A, 6B, and 6C are perspective views of a coupling section according to another modification.
Figure 6B:
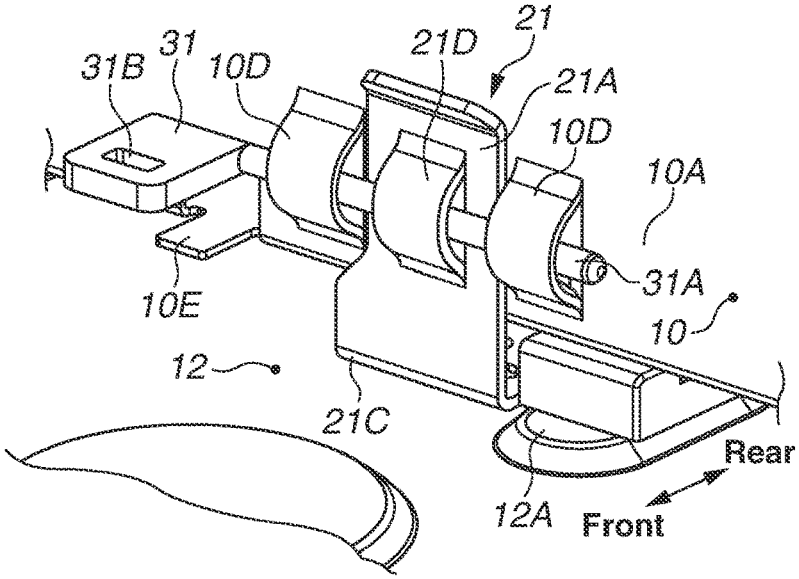
Figure 6C:
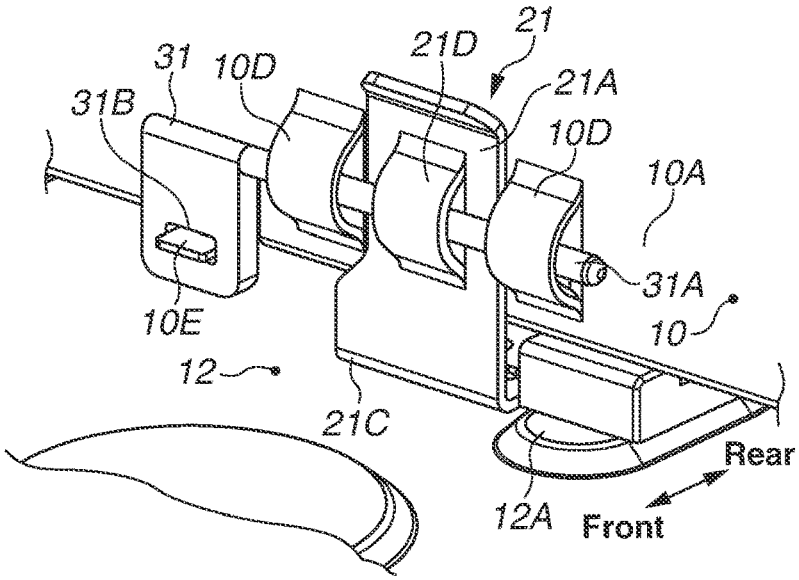

Furthermore, in the present exemplary embodiment, the screw 15 is used as a fixing unit and each the coupling sections 21 is fixed to the rear side plate 10A of the frame 10. However, the present disclosure is not limited to this. Any fixing unit can be used as long as the fixing unit can fix each of the coupling sections 21 to the frame 10, and a bolt can be used as a fixing unit, as illustrated in FIGS. 6B and 6C.

Specifically, the coupling section 21 has abridge-like, lance-shaped portion 21D that is arranged between two openings extending in the first portion 21A in a direction away from the bent portion 21C (a vertical direction of the image forming apparatus 1) and protrudes from the outside of the image forming apparatus 1 to an inside of the image forming apparatus 1 (FIG. 6A), in place of the circular hole 22. Similarly, two lance-shaped portions 10D are arranged in the rear side plate 10A of the frame 10 such that the first portion 21A is sandwiched between the lance-shaped portions 10D, in place of the circular hole 10B. The lance-shaped portions 10D are each a bridge-like portion that is located between two openings extending in the vertical direction of the image forming apparatus 1 and protrudes from the outside of the image forming apparatus 1 to the inside of the image forming apparatus 1.

In this modification, the coupling section 21 where the lance-shaped portion 21D is formed is arranged between the lance-shaped portions 10D, and the lance-shaped portions 10D and the lance-shaped portion 21D are aligned substantially horizontally in a case where the apparatus main body 2 is installed on the paper feed device 3.

A pin 31 that serves as a bolt is prepared. The pin 31 has a rod-shaped portion 31A and a positioning hole 31B. In the space 27 formed by removing the paper feed cassette 9 of the apparatus main body 2 to the outside of the image forming apparatus 1, the rod-shaped portion 31A of the pin 31 is inserted into the three lance-shaped portions 10D and 21D (see FIG. 6B) to fix the coupling section 21 to the apparatus main body 2. In this way, the apparatus main body 2 and the paper feed device 3 can be coupled together by the coupling sections 21. Further in this modification, it is preferable that the pin 31 is rotated to engage the positioning hole 31B of the pin 31 with a tab 10E provided on the rear side plate 10A of the frame 10 (see FIG. 6C) to prevent the rod-shaped portion 31A of the pin 31 from coming off from the three lance-shaped portions 10D and 21D.

As described above, it is possible to make appropriate changes within the scope of the present disclosure. Embodiment(s) of the present disclosure can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may include one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read-only memory (ROM), a storage of distributed computing systems, an optical disk (such as a compact disc (CD), digital versatile disc (DVD), or Blu-ray Disc (BD)™), a flash memory device, a memory card, and the like.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2019-175898, filed Sep. 26, 2019, which is hereby incorporated by reference herein in its entirety.

What is claimed is:

1. An image forming apparatus comprising:

an image forming apparatus main body including a paper feed cassette, configured to be removable from the image forming apparatus main body and to store paper, and including an image forming unit configured to form an image on the paper; and a paper feed device configured to store the paper below the paper feed cassette and provided with a coupling section, wherein, in a space formed in a case where the paper feed cassette is removed from the image forming apparatus main body, the coupling section is fixed to the image forming apparatus main body by a fixing unit to couple the image forming apparatus main body and the paper feed device together, and wherein the fixing unit includes a screw.

2. The image forming apparatus according to claim 1, wherein the coupling section is provided above the paper feed device.

3. The image forming apparatus according to claim 1, wherein the paper feed device is provided with a plurality of positioning units configured to engage with a frame of the image forming apparatus main body, and wherein the coupling section is arranged between the plurality of positioning units.

4. The image forming apparatus according to claim 1, wherein a frame of the image forming apparatus main body is located on one side of the coupling section either inside the image forming apparatus or outside the image forming apparatus, and wherein the coupling section has a shape extending toward the one side of the coupling section as approaching the image forming apparatus.

5. The image forming apparatus according to claim 1, wherein the coupling section is removable from the paper feed device.

6. The image forming apparatus according to claim 5, wherein the coupling section includes a first portion fixed to the image forming apparatus main body and a second portion fixed to the paper feed device, and wherein the first portion and the second portion are connected to each other via a bent portion.

7. A paper feed system comprising:

a first paper feed device having a first paper feed cassette configured to be removable from the first paper feed device and configured to store paper, wherein the first paper feed device is configured to allow an image forming apparatus main body to be stacked on the first paper feed device, and wherein the image forming apparatus main body includes an image forming unit configured to form an image on the paper; and a second paper feed device configured to allow the first paper feed device, on which the image forming apparatus main body has been stacked, to be stacked on the second paper feed device, wherein the second paper feed device includes a second paper feed cassette configured to be removable from the second paper feed device and to store the paper, wherein the second paper feed device is provided with a coupling section, wherein, in a space formed in a case where the first paper feed cassette is removed from the first paper feed device, the coupling section is fixed to the image forming apparatus main body by a fixing unit to couple the first paper feed device and the second paper feed device together, and wherein the fixing unit includes a screw.

8. The paper feed system according to claim 7, wherein the coupling section is provided above the second paper feed device.

9. The paper feed system according to claim 7, wherein the second paper feed device is provided with a plurality of positioning units configured to engage with a frame of the first paper feed device, and wherein the coupling section is arranged between the plurality of positioning units.

10. The paper feed system according to claim 7, wherein a frame of the first paper feed device is located on one side of the coupling section either inside the first paper feed device or outside the first paper feed device, and wherein the coupling section has a shape extending toward the one side of the coupling section as approaching the first paper feed device.

11. The paper feed system according to claim 7, wherein the coupling section is removable from the second paper feed device.

12. The paper feed system according to claim 11, wherein the coupling section includes a first portion fixed to the first paper feed device and a second portion fixed to the second paper feed device, and wherein the first portion and the second portion are connected to each other via a bent portion.

13. An image forming apparatus comprising:

an image forming apparatus main body including a cassette, configured to be removable from the image forming apparatus main body and to store paper, and including an image forming unit configured to form an image on the paper;

a feeding device located below the cassette and configured to store the paper and supply the paper to the image forming unit;

a coupling section configured to couple the image forming apparatus main body and the feeding device; and a fixing member configured to fix the coupling section to the image forming apparatus, wherein the fixing member is removable from the image forming apparatus main body using a space formed by removing the cassette.

14. The image forming apparatus according to claim 13, wherein the feeding device is provided with a plurality of positioning units configured to engage with a frame of the image forming apparatus main body, and wherein the coupling section is arranged between the plurality of positioning units.

15. The image forming apparatus according to claim 14, wherein a frame of the image forming apparatus main body is located on one side of the coupling section either inside the image forming apparatus or outside the image forming apparatus, and wherein the coupling section has a shape extending toward the one side of the coupling section as approaching the image forming apparatus.

16. The image forming apparatus according to claim 13, wherein the coupling section includes a first portion fixed to the image forming apparatus main body and a second portion fixed to the feeding device, and wherein the first portion and the second portion are connected to each other via a bent portion.

17. The image forming apparatus according to claim 13, wherein the fixing member is a screw.

18. The image forming apparatus according to claim 17, wherein the screw is removable from the image forming apparatus in a direction parallel to a direction of detachment of the cassette.

* * * * *